United States Patent [19]

Archer

[11] 3,979,754

[45] Sept. 7, 1976

[54] RADIO FREQUENCY ARRAY ANTENNA EMPLOYING STACKED PARALLEL PLATE LENSES

[75] Inventor: Donald H. Archer, Santa Barbara, Calif.

[73] Assignee: Raytheon Company, Lexington, Mass.

[22] Filed: Apr. 11, 1975

[21] Appl. No.: 567,330

[52] U.S. Cl. ..... 343/754; 343/854

[51] Int. Cl.[2] ..... H01Q 3/26

[58] Field of Search ..... 343/854, 754

[56] References Cited

UNITED STATES PATENTS

| | | | |
|---|---|---|---|
| 3,653,057 | 3/1972 | Charlton | 343/854 |
| 3,729,742 | 4/1973 | Boyns | 343/854 |
| 3,911,442 | 10/1975 | Hatch | 343/854 |

*Primary Examiner*—Eli Lieberman

*Attorney, Agent, or Firm*—Richard M. Sharkansky; Philip J. McFarland; Joseph D. Pannone

[57] ABSTRACT

A radio frequency multibeam array antenna is disclosed wherein a beam forming network includes a first set of vertically disposed parallel plate lenses coupled between a matrix of radiating elements and a second set of horizontally disposed parallel plate lenses. With such a beam forming network a plurality of narrow pencil-shaped beams of radiation may be formed over a relatively large solid angle.

2 Claims, 1 Drawing Figure

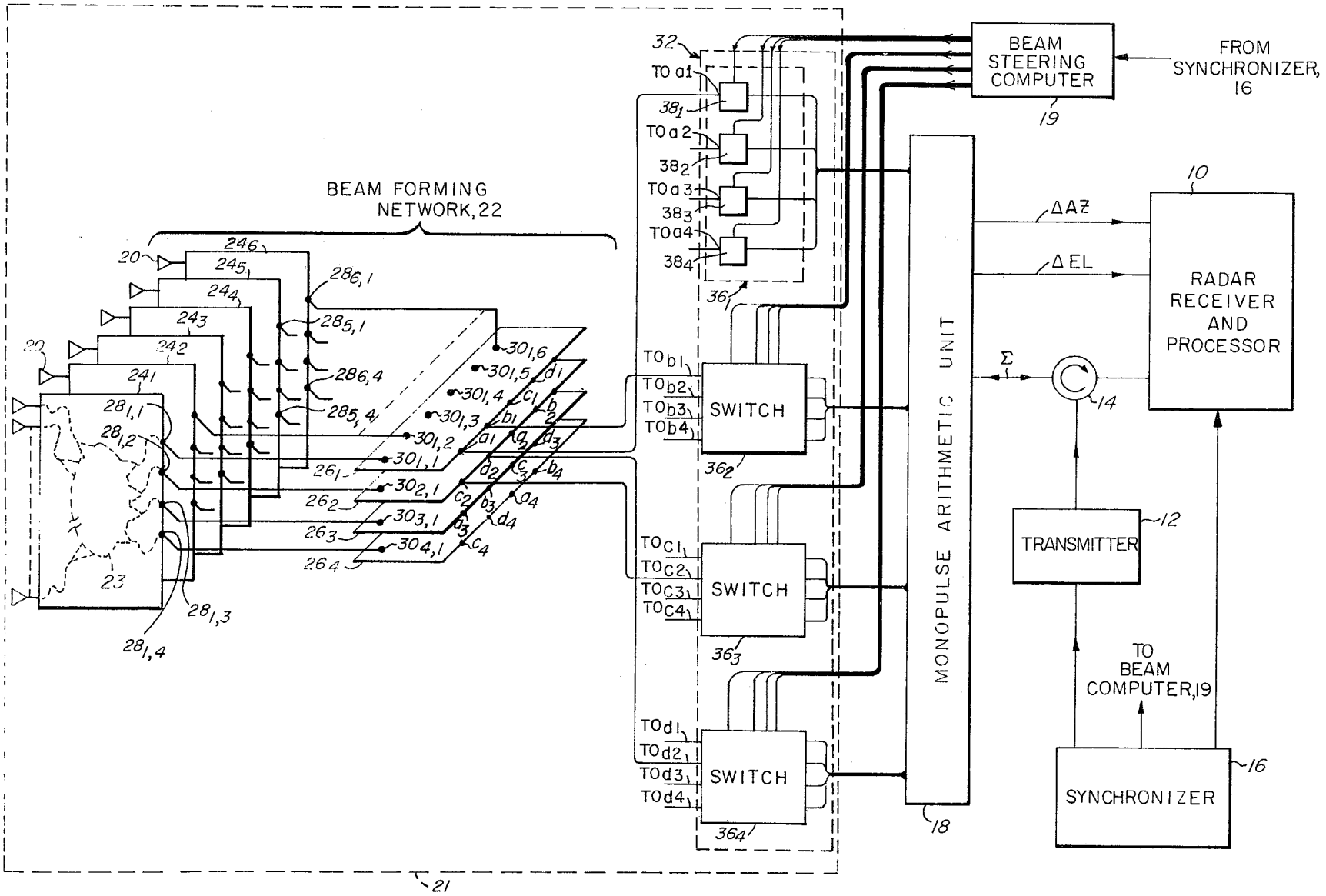
FROM SYNCHRONIZER, 16
BEAM STEERING COMPUTER
19
RADAR RECEIVER AND PROCESSOR
10
ΔAZ
ΔEL
Σ
14
TRANSMITTER
12
TO BEAM COMPUTER, 19
SYNCHRONIZER
16
MONOPULSE ARITHMETIC UNIT
18
SWITCH
362
SWITCH
363
SWITCH
364
36
32
TO a1
TO a2
TO a3
TO a4
TO b1
TO b2
TO b3
TO b4
TO c1
TO c2
TO c3
TO c4
TO d1
TO d2
TO d3
TO d4
BEAM FORMING NETWORK, 22
20
21
23

RADIO FREQUENCY ARRAY ANTENNA EMPLOYING STACKED PARALLEL PLATE LENSES

The invention herein described was made in the course of or under a contract or subcontract thereunder, with the Department of Defense.

BACKGROUND OF THE INVENTION

This invention relates generally to radio frequency array antennas and more particularly to two-dimensional multibeam array antennas.

As is known in the art, it is sometimes desirable to feed a two-dimensional array of radiating antenna elements with a beam-forming network to form a number of pencil-shaped beams of radio frequency energy disposed to cover a relatively large solid angle. One known array antenna adapted to provide such pencil-shaped beams is the so-called "bootlace lens" described in an article entitled "The Bootlace Lens", Royal Radar Establishment Journal, pp. 47–57, Oct. 1958, by H. Gent. Here a number of two-dimensional beams is formed by radiating from a feed horn into a two-dimensional array of pickup horns which in turn are connected through cables of appropriate length to the array radiating elements. While such an arrangement may be useful in many applications, it is relatively large and voluminous and hence not readily adapted for applications where space and weight are at a premium such as in missile or airplane applications.

SUMMARY OF THE INVENTION

It is therefore an object of this invention to provide an improved two-dimensional array antenna adapted to form pencil-shaped beams of radio frequency energy throughout relatively large solid angles.

It is a further object of this invention to provide a compact, light-weight, two-dimensional array antenna adapted to form pencil-shaped beams of radiation throughout relatively large solid angles.

These and other objects of the invention are attained generally by providing, in an array antenna wherein a plurality of radiating elements are arranged in a matrix of rows and columns, a beam forming network having: a set of radio frequency lenses which are coupled to the radiating elements and including a plurality of feed ports, the feed ports of the plurality of radio frequency lenses being arranged in rows orthogonal to the columns of radiating elements, and, means for introducing radio frequency energy into selected feedports. With such an arrangement a plurality of narrow pencil-shaped beams of radiation may be formed over a relatively large solid angle.

DESCRIPTION OF THE PREFERRED EMBODIMENTS

Referring now to the single FIGURE, a radar receiver and processor 10, radar transmitter 12, circulator 14, synchronizer 16, monopulse arithmetic unit 18 and beam steering computer 19, all of conventional design, are shown coupled to a two-dimensional multibeam array antenna system 21 of a type contemplated by this invention to form a monopulse radar system.

The two-dimensional multibeam array antenna system 21 includes a plurality of radiating elements 20 arranged in a matrix, here having six columns and *m* rows. The radiating elements are coupled to a beam forming network 22. Such beam forming network 22 is made up of two sets of radio frequency parallel plate lenses; one such set here including six individual parallel plate lens systems, $\mathbf{24_1}$–$\mathbf{24_6}$, disposed in adjacent vertical planes, and the second set of parallel plate lenses here including four individual parallel plate lens systems $\mathbf{26_1}$–$\mathbf{26_4}$, disposed in adjacent horizontal planes, as shown. Each individual one of the radio frequency parallel plate lens systems $\mathbf{24_1}$–$\mathbf{24_6}$ and $\mathbf{26_1}$–$\mathbf{26_4}$ preferably is of the two-dimensional constrained electromagnetic lens system described in U.S. Pat. No. 3,761,936, "Multi-Beam Array Antenna", D. H. Archer, R. J. Prickett and C. P. Hartwig, inventors, issued Sept. 25, 1973, and assigned to the same assignee as the present invention. For convenience parallel plate lens system $\mathbf{24_1}$ is shown in phantom to include a parallel plate lens 23 and coupling circuitry (not numbered).

As shown, the antenna elements 20 in each one of the six rows thereof is coupled to a different one of the vertically positioned radio frequency parallel plate lens systems $\mathbf{24_1}$–$\mathbf{24_6}$, here by conventional coaxial cables. Here each one of such parallel plate lens systems $\mathbf{24_1}$–$\mathbf{24_6}$ has four input ports designated, respectively, $\mathbf{28_{1,1}}$–$\mathbf{28_{1,4}}$ . . . $\mathbf{28_{6,1}}$–$\mathbf{28_{6,4}}$, (only representative ones being numbered). Each one of the horizontally positioned radio frequency parallel plate lens systems $\mathbf{26_1}$–$\mathbf{26_4}$ here includes six output ports designated, respectively, $\mathbf{30_{1,1}}$–$\mathbf{30_{1,6}}$ . . . $\mathbf{30_{4,1}}$–$\mathbf{30_{4,6}}$, (only representative ones being numbered) as shown. It is here noted that five of the output ports of each one of the parallel plate lens systems $\mathbf{26_2}$–$\mathbf{26_4}$ are obscured from view in the FIGURE.

The input ports of the vertically positioned parallel plate lens systems $\mathbf{24_1}$–$\mathbf{24_6}$ are coupled to the plurality of horizontally positioned parallel plate lens systems $\mathbf{26_1}$–$\mathbf{26_4}$, as shown. Here such coupling is by coaxial cables, each having the same electrical length. In particular, the input ports of the parallel plate lens system $\mathbf{24_1}$ are coupled to the first output port of each one of the parallel plate lens systems $\mathbf{26_1}$–$\mathbf{26_4}$, respectively, as indicated; that is, input ports $\mathbf{28_{1,1}}$–$\mathbf{28_{1,4}}$ are coupled to output ports $\mathbf{30_{1,1}}$–$\mathbf{30_{4,1}}$, respectively. Further, input ports $\mathbf{28_{2,1}}$–$\mathbf{28_{2,4}}$ are coupled to output ports $\mathbf{30_{1,2}}$–$\mathbf{30_{4,2}}$, respectively and so forth so that the input ports of any one of the vertically positioned parallel plate lens systems $\mathbf{24_1}$–$\mathbf{24_6}$ are coupled to a different one of the output ports of the horizontally positioned parallel plate lens systems $\mathbf{26_1}$–$\mathbf{26_4}$ and further so that the input ports of adjacent vertically positioned parallel plate lens systems $\mathbf{24_1}$–$\mathbf{24_4}$ are coupled to adjacent output ports of the horizontally positioned parallel plate lens systems $\mathbf{26_1}$–$\mathbf{26_4}$. That is, the input ports of the vertically positioned parallel plate lens systems $\mathbf{24_1}$–$\mathbf{24_6}$ may be considered to be the columns in a rectangular matrix and the output ports of each one of the horizontally positioned parallel plate lens systems $\mathbf{26_1}$–$\mathbf{26_4}$ may be considered to be the rows in such matrix.

Each one of the horizontally positioned parallel plate lens systems $\mathbf{26_1}$–$\mathbf{26_4}$ has four input ports designated: $a_1$, $b_1$, $c_1$, $d_1$ respectively for parallel plate lens system $\mathbf{26_1}$; $c_2$, $d_2$, $a_2$, $b_2$, respectively for parallel plate lens system $\mathbf{26_2}$; $a_3$, $b_3$, $c_3$, $d_3$, respectively for parallel plate lens system $\mathbf{26_3}$; and $c_4$, $d_4$, $a_4$, $b_4$, respectively for parallel plate lens system $\mathbf{26_4}$ as shown to form a matrix of input ports.

Four adjacent ones of the input ports, here input ports $a_1$–$a_4$, $b_1$–$b_4$, $c_1$–$c_4$ and $d_1$–$d_4$ are coupled selectively through a switching network 32 to the monopulse arithmetic unit in accordance with control signals supplied by the beam steering computer 16. As shown, the switching network 32 includes four switch assemblies $\mathbf{36_1}$–$\mathbf{36_4}$, each one of identical construction, the details being shown in exemplary switch assembly $\mathbf{36_1}$. That switch assembly includes four diode gates, $\mathbf{38_1}$–$\mathbf{38_4}$. One side of each of the gates $\mathbf{38_1}$–$\mathbf{38_4}$ is coupled to the monopulse arithmetic unit 18 and the other side is coupled to a different one of the input ports $a_1$, $a_2$, $a_3$, $a_4$. For clarity only the connection between gate $\mathbf{38_1}$ and $a_1$ is shown. Switch assembly $\mathbf{36_1}$ then couples any selected one of the four input ports $a_1$–$a_4$ (here input port $a_1$) to the monopulse arithmetic unit 18 in response to a particular enabling signal from the beam steering computer 19. Similarly, switch assembly $\mathbf{36_2}$ has coupled to it the input ports $b_1$–$b_4$; switch assembly $\mathbf{36_3}$ has coupled to it the input ports $c_1$–$c_4$; and switch assembly $\mathbf{36_4}$ has coupled to it the input ports $d_1$–$d_4$, again only a selected one of the couplings being shown for clarity. It follows then that with such an arrangement any four adjacent ones of the input ports $a_1$–$a_4$, $b_1$–$b_4$, $c_1$–$c_4$ and $d_1$–$d_4$ may be coupled to the arithmetic unit 18 in response to control signals supplied by the beam steering computer 19. The monopulse arithmetic unit 18 interconnects the four selected adjacent input ports in a conventional way to form an azimuthal difference channel, $\Delta_{AZ}$, an elevation difference channel $\Delta_{EL}$, and a sum channel $\Sigma$ as indicated.

Let us now consider the operation of the beam forming network 22 during transmission, realizing that during reception the network 22 operates reciprocally. The radio frequency signal output from the transmitter 12 passes into the circulator 14 from which it emerges and passes into the $\Sigma$ channel input port of the monopulse arithmetic network which, in turn, divides the transmit signal into four equal-amplitude, equal-phase output signals. These four signals then pass into the four switches $\mathbf{36_1}$–$\mathbf{36_4}$ whose diode gates have been appropriately enabled by the beam steering computer 19 to cause the four signals to be coupled to the desired four adjacent ones of the input ports $a_1$–$a_4$, $b_1$–$b_4$, $c_1$–$c_4$ and $d_1$–$d_4$ (here $a_1$, $b_1$, $c_1$, and $d_1$). It follows then that the radio frequency input transmit energy becomes focused by two of the horizontally disposed lens systems $\mathbf{26_1}$–$\mathbf{26_4}$ to the output ports of such lens systems in accordance with the disposition of the two energized input ports of each one of the two energized lens systems. Therefore, the energized horizontally disposed radio frequency lens systems may be viewed, for purposes of explanation, as having focused the transmitted radio frequency energy into four overlapping energy patterns, which, if allowed to radiate without further focusing, would form a cluster of four overlapping elliptically shaped beams having vertically disposed major axes. The directions, in elevation, of the centerlines of all four such beams are the same, but the direction, in azimuth of the centerline of each one of such beams is dependent upon which ones of the input ports to the horizontally disposed radio frequency lens systems are energized. Each one of such energy patterns is then passed to a particular row of the input ports, for example $\mathbf{28_{1,1}}$–$\mathbf{28_{6,1}}$, of the vertically disposed radio frequency lens systems $\mathbf{24_1}$–$\mathbf{24_6}$. As with the horizontally disposed lens systems, each of the vertically disposed radio frequency lens systems $\mathbf{24_1}$–$\mathbf{24_6}$ would, alone, focus its input energy in the vertical plane to produce elliptically shaped beams having major axes horizontally disposed. The direction, in elevation, of the centerline of each one of such beams is dependent upon which ones of the input ports to the vertically disposed radio frequency lens systems are energized. Here, however, all of the vertically disposed radio frequency lens systems are being simultaneously energized by the horizontally focused energy pattern coupled to them from the output ports of the horizontally disposed radio frequency lens systems $\mathbf{26_1}$–$\mathbf{26_4}$. Hence the effect of such vertically disposed radio frequency lens systems $\mathbf{24_1}$–$\mathbf{24_6}$ is to provide beam focusing in the vertical plane. The final results of the focusing, first in one plane and then in the orthogonal plane, is that four monopulse beams having substantially circular transverse cross sections are radiated from the array. The beamwidths of the beams so formed are determined by both the dimensions of the radiating face of the array (the spacing between and number of radiating elements) and the operating frequency. Further, the direction of the beams is determined by the position of the four adjacent input ports in the matrix thereof selectively coupled to the monopulse arithmetic unit 18 by the beam steering computer 19.

Having described a preferred embodiment of this invention it will now be evident to those skilled in the art that changes and modifications may be made without departing from the inventive concepts. For example while here each one of the parallel plate lens systems $\mathbf{24_1}$–$\mathbf{24_6}$, $\mathbf{26_1}$–$\mathbf{26_4}$ include coupling circuitry (not numbered) in addition to a parallel plate lens 23, such systems may include the lens 23 without such coupling circuitry by appropriately changing the electrical lengths of the coaxial cables in accordance with the referenced U.S. Patent.

What is claimed is:

1. An antenna array in a monopulse radar for forming, simultaneously, a desired set of overlapping directional beams, each one of such beams having a substantially circular cross section, such array comprising:

a. a first set of parallel plate radio frequency lenses, each one of such lenses including a first plurality of feedports and a second plurality of output ports, each one of such feedports in each one of such parallel plate radio frequency lenses being coupled through a different electrical path to all of the output ports in the corresponding lens, the lengths of the different electrical paths from each one of the feedports to the output ports being selected to form a first set of overlapping energy distributions corresponding in number to the desired set of directional beams;

b. a second set of parallel plate radio frequency lenses, the number of such lenses in such second set being equal to the number of output ports in each one of the parallel plate lenses in the first set thereof, each one of the parallel plate radio frequency lenses in such second set having a third plurality of input ports equal in number to the number of parallel plate radio frequency lenses in the first set and a fourth plurality of output ports, each one of the third and fourth plurality of input and output ports being coupled through a different electrical path to form a second set of overlapping energy distributions corresponding in number to the desired set of directional beams;

c. means for interconnecting, through predetermined length paths, one of the output ports in the first set of parallel plate radio frequency lenses to a corresponding one of the input ports in the second set of parallel plate radio frequency lenses; and d. means for connecting each one of the output ports in the second set of parallel plate radio frequency lenses to a different antenna element.

2. An array antenna system comprising:

a. a first set of radio frequency lenses having a plurality of output ports coupled to a like plurality of antenna elements, each one of such lenses having a like plurality of input ports;

b. a second set of radio frequency lenses, each one of such lenses having a plurality of input ports and a plurality of output ports, the number of output ports of each one of the lenses being equal to the lenses in the first set, the number of lenses in the second set being equal to the number of input ports of one of the lenses in the first set;

c. means for coupling the input ports of each one of the lenses in the first set to different ones of the lenses in the second set;

d. a monopulse arithmetic unit; and e. switching means for coupling the monopulse arithmetic unit to selected ones of the input ports of the second set of radio frequency lenses.

* * * * *